US008496020B1

(12) United States Patent
Westerberg

(10) Patent No.: US 8,496,020 B1
(45) Date of Patent: Jul. 30, 2013

(54) TAP AND DRAINING DEVICE FOR A FILTER CARTRIDGE

(76) Inventor: Layne T. Westerberg, McKinnon, WY (US)

( * ) Notice: Subject to any disclaimer, the term of this patent is extended or adjusted under 35 U.S.C. 154(b) by 324 days.

(21) Appl. No.: 13/010,113

(22) Filed: Jan. 20, 2011

(51) Int. Cl.
*B23B 41/08* (2006.01)

(52) U.S. Cl.
USPC ..... 137/15.14; 222/83; 184/1.15

(58) Field of Classification Search
USPC ..... 137/15.12, 15.13, 15.14, 317, 318; 222/81–90; 141/65, 329; 184/1.5
See application file for complete search history.

(56) References Cited

U.S. PATENT DOCUMENTS 4,865,156 A * 9/1989 Poling ..... 184/1.5
5,299,714 A 4/1994 Kilgore
5,390,823 A 2/1995 Kilgore
5,476,154 A * 12/1995 Sage ..... 184/1.5
5,533,554 A 7/1996 Young
5,558,140 A 9/1996 Clark, II
5,598,951 A 2/1997 DeBano, Jr.
5,803,140 A 9/1998 Jodoin
5,896,886 A 4/1999 Wendt
5,979,516 A * 11/1999 Grant ..... 141/331
6,199,578 B1 3/2001 Clark, II
6,234,350 B1 * 5/2001 Dagn ..... 222/83.5

* cited by examiner

*Primary Examiner* — John Rivell
*Assistant Examiner* — Reinaldo Sanchez-Medina
(74) *Attorney, Agent, or Firm* — Montgomery Patent & Design; Robert C. Montgomery

(57) ABSTRACT

A tap and draining device for a filter cartridge that allows removal of excess fluids to be removed from a filter prior to filter removal in an effort to reduce fluid spillage and associated contamination includes an angled hollow punch in fluid communication with a valve and flexible tube for controlled drainage. A magnet is provided along a top surface to hold and seal the device against the oil filter. A user taps a bottom surface of the device, thereby causing the beveled tap to penetrate the filter. Once fully inserted, the device allows fluid to drain through an internal port and out the attached tubing, preferably into a container where it may be discarded or recycled as required.

16 Claims, 3 Drawing Sheets

TAP AND DRAINING DEVICE FOR A FILTER CARTRIDGE

RELATED APPLICATIONS

The present invention was first described in a notarized Official Record of Invention on Oct. 12, 2009, that is on file at the offices of Montgomery Patent and Design, LLC, the entire disclosures of which are incorporated herein by reference.

FIELD OF THE INVENTION

The present invention relates generally to fluid draining devices, and in particular, to a device for tapping an exterior of a filter cartridge and draining a fluid filled interior.

BACKGROUND OF THE INVENTION

Modern internal combustion engines are a true engineering marvel. Their long run time between major maintenance is in stark contrast to engines of even a few decades ago that required constant adjustment and maintenance to keep them operational. While tune-ups and major repair of modern engines are rare, they still do require regular and periodic maintenance, with perhaps the most important of these being regular oil changes. Typically, oil replacement procedures include placing a fluid receiving container under the oil pan, removing the oil pan drain plug, and draining the oil from the oil pan. Additionally, the oil filter must also be removed and replaced by unscrewing the filter from the engine block. While this task is simple and typically requires little effort, it often becomes a nuisance due to the mess, spills, and drips that occur during the oil change process. Much of this mess occurs when removing the oil filter, due to the fact that it is usually filled with oil and positioned in a manner such that spillage upon its removal is inevitable.

Various attempts have been made to overcome these problems; from as simple as driving a nail or screw driver into the body of the filter to more complex types of fluid and oil draining devices. Examples of these devices can be seen by referencing several U.S. Patents; including U.S. Pat. No. 5,299,714, issued to Kilgore, which discloses an oil filter puncturing, draining, and socket extension device. The Kilgore device includes a drain tube with sharp tip which is driven into the oil filter to drain the interior fluid and a valve for release of the fluid. U.S. Pat. No. 5,390,823, also issued to Kilgore discloses an oil filter hand punch and drain tool which is driven into the interior of the filter such that the interior fluid can be drained through a cavity within the tool.

U.S. Pat. No. 5,558,140, issued to Clark, II, discloses a device for draining fluid from a container having a threaded screw with a sharp tip and a channel for penetrating the fluid container and a fluid valve which is fittingly connected to a suction line to evacuate the fluid.

U.S. Pat. No. 5,598,951, issued to DeBano, Jr., discloses an oil filter draining device having a hollow shaft with a closed end, an open end having a point for piercing the filter, and a flexible boot for covering the point and sealing the device to the exterior of the filter.

U.S. Pat. No. 6,199,578, also issued to Clark, II, discloses a device for draining fluid from a container having a drill bit with a sharpened point for piercing the filter, exterior channels for channeling the fluid, and a drill bit holder with a valve for receiving the fluid from the bit and draining the fluid.

While these attempts may achieve their particular objectives, each suffers from at least one (1) disadvantage or deficiency related to design or utilization. Particularly related to the lack of way to maintain the device to the filter while drainage occurs, the ability to easily and simply remove components for cleaning or replacement, and durability.

SUMMARY OF THE INVENTION

The inventor has recognized the aforementioned inherent problems and current lack in the art and observed that there is a need for a means by which oil filters can be easily replaced without the mess and fuss as described above. It is an object of the present disclosure to solve these problems.

The inventor recognized these problems and has addressed this need by developing a tap and draining device for filter cartridge which allows professionals and do-it-yourselfers alike to easily remove a used oil filter without the usual spills, drips, and mess typically associated with the task. The inventor has thus realized the advantages and benefits of providing a tap and draining device for a filter cartridge including a handle assembly which is removably coupled to an exterior of a filter cartridge. The handle assembly includes an upper cavity disposed within an upper end and a generally "L"-shaped drain port disposed through the body. The drain port has a threaded inlet end centrally disposed within the upper cavity and a threaded outlet end exiting a side wall of the handle assembly. A lower conduit is disposed within the upper cavity having a threaded upper end and a threaded lower end adapted to be threadingly mated with the drain port inlet end. A tapping nozzle is provided having an outwardly flanged lower end mated to the lower conduit and a beveled upper end terminating in a point for penetrating the filter cartridge exterior. The tapping nozzle comes into fluid communication with an interior of the filter cartridge and is in fluid communication with the lower conduit upper end. A union nut is provide having a central aperture disposed in a top surface for receiving the tapping nozzle and a threaded lower end adapted to threadingly mate with the lower conduit upper end and compressively mate the tapping nozzle to the lower conduit upper end. A valve is threadingly connected to and is in fluid communication with the drain port outlet end and provides control of a fluid flow from the drain port. A flexible drain hose is removably connected to and is in fluid communication with the valve. An impact plate is affixed to a bottom surface of the handle assembly, where striking the impact plate drives the tapping nozzle into the filter cartridge interior. A magnetic ring is affixed to an upper horizontal edge of the handle assembly between the handle assembly side wall and the upper cavity to magnetically attach the device to the filter.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
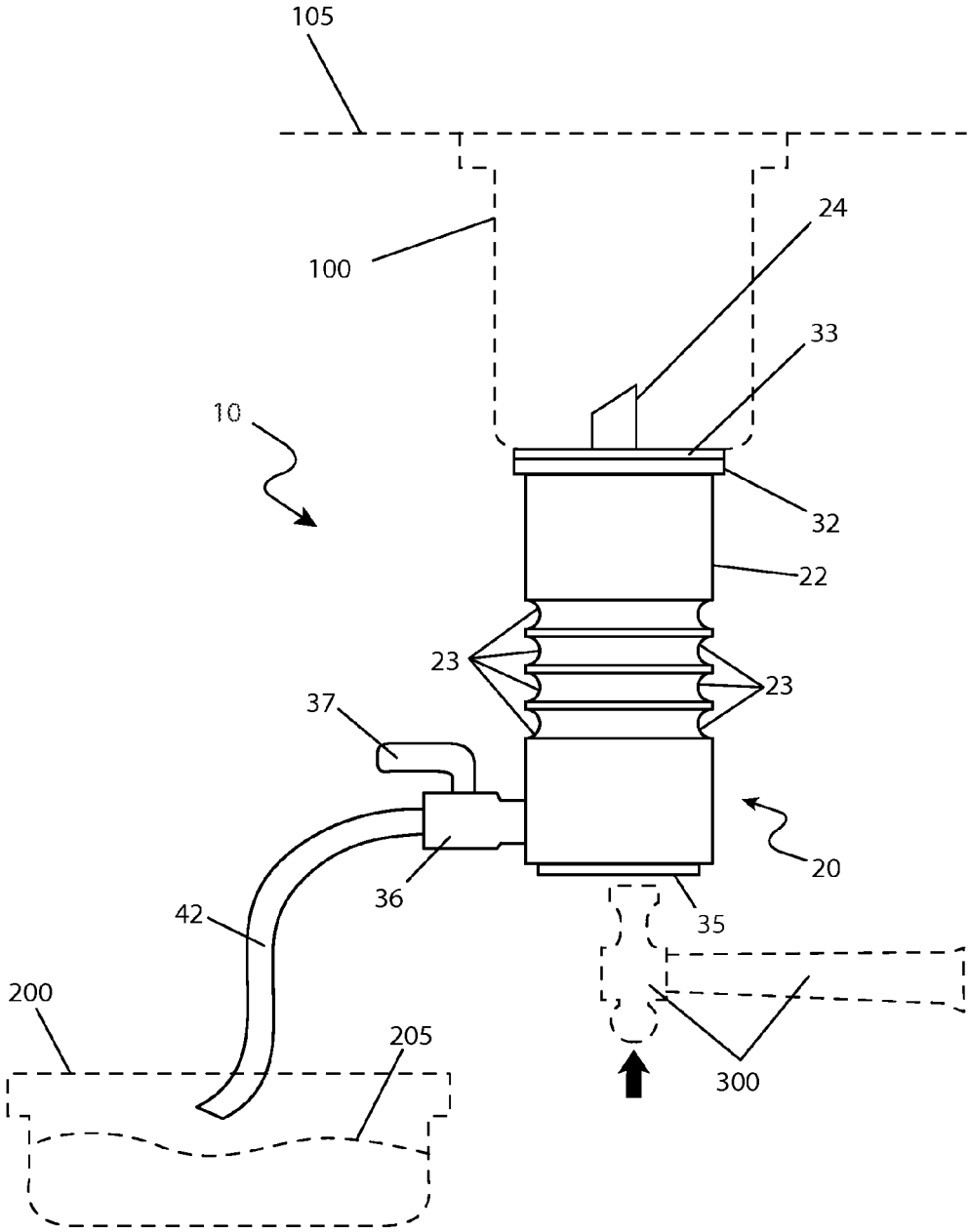
FIG. 1 is an environmental view of a tap and draining device for a filter cartridge 10, according to a preferred embodiment.

10 tap and draining device for a filter cartridge
20 handle assembly
22 body
23 finger relief
24 tapping nozzle
25 bevel
26 drain port
27 lower conduit
28 upper cavity
30 union nut
32 magnet
33 sealing layer
34 adhesive layer
35 impact plate
36 valve
37 valve handle
42 drain hose
90 weld
100 cartridge filter
105 vehicle
200 container
205 fluid
300 hammer

DETAILED DESCRIPTION OF THE PREFERRED EMBODIMENT

Figure 2:
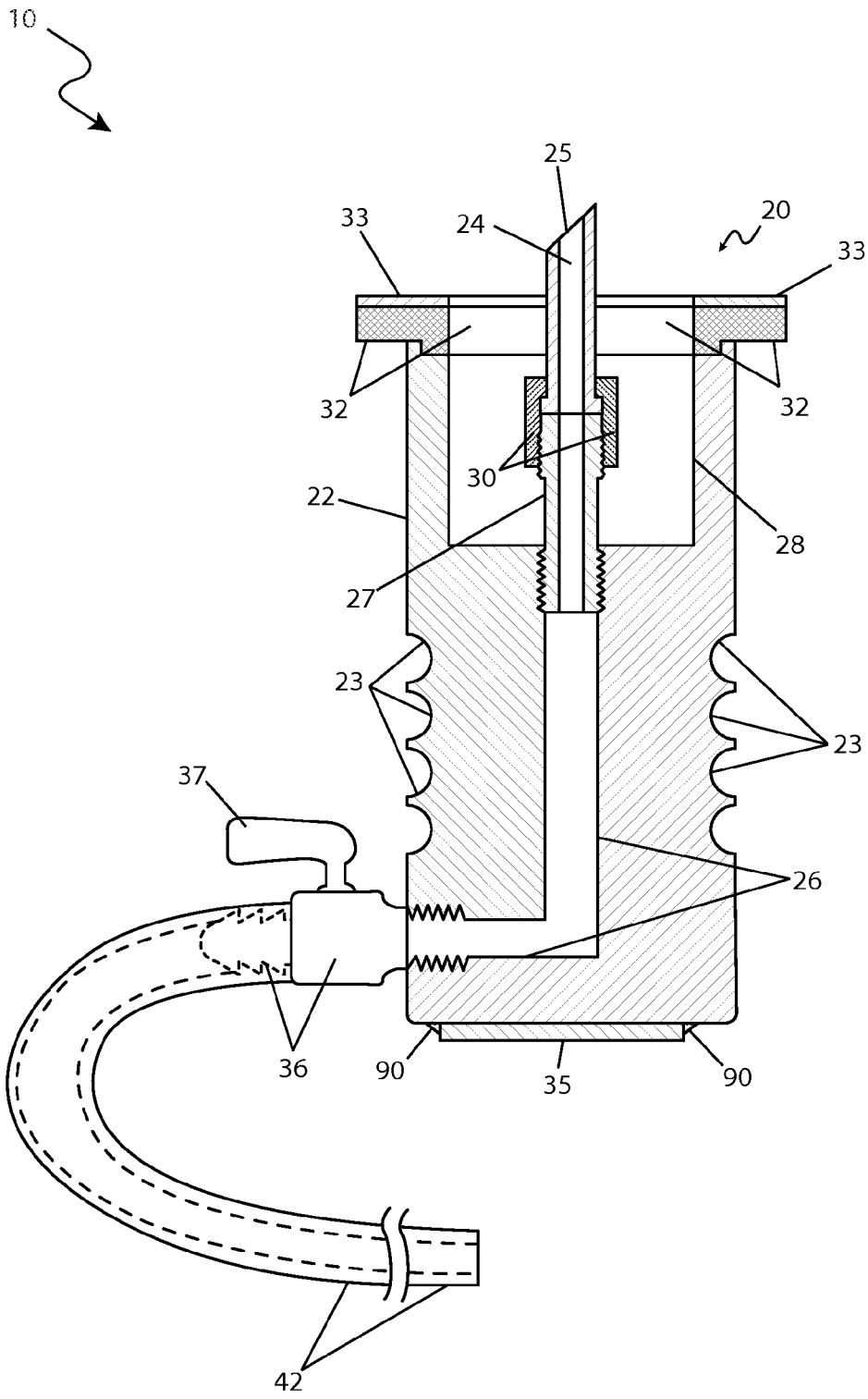
FIG. 2 is a cross section view of the tap and draining device for a filter cartridge 10, according to the preferred embodiment; and, FIG. 3 is a partial section view of a magnet 32 of the tap and draining device for a filter cartridge 10, according to the preferred embodiment.
Figure 3:
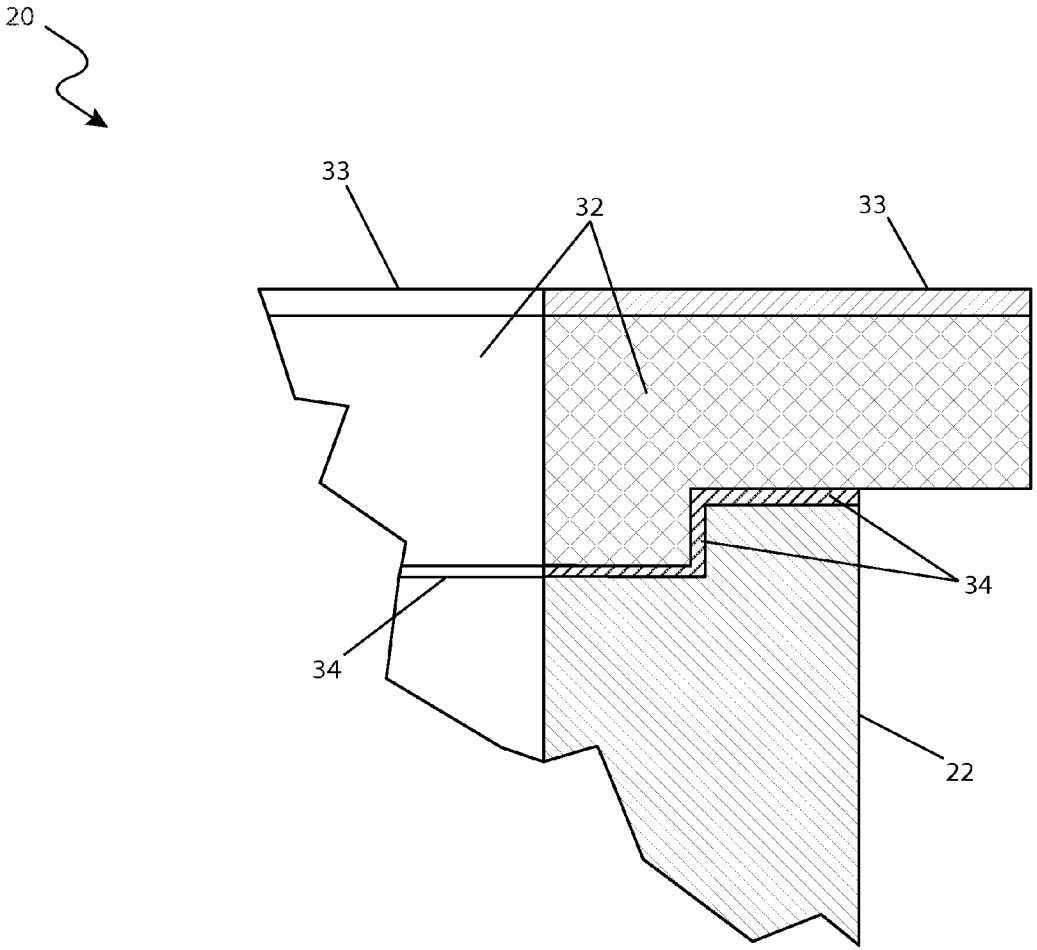

The best mode for carrying out the disclosure is presented in terms of a preferred embodiment, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIG. 1, an environmental view of the tap and draining device for a filter cartridge (herein described as a "device") 10 is disclosed. The device 10 allows for the drainage of excess fluids 205 such as oil, water, fuel oil, and the like, shown here being applied to a cartridge filter 100 upon a vehicle 105 prior to removal during a maintenance activity. The device 10 may also be applied to various replaceable fluid filtration or separation vessels which are removably connected to industrial machines or other mechanisms, thereby reducing spillage of the fluids 205 and avoiding associated contamination. The device 10 can also provide for a diagnostic or troubleshooting to the vehicle 105 by allowing a user to isolate and examine a condition of the drained fluid 205 to detect contained substances such as metal particles, various fluid contaminants, and the like.

The device 10 includes a beveled tapping nozzle 24 removably connected to a cylindrical handle assembly 20 which allows for the drainage of the fluid 205 by a valve 36 and a flexible plastic or rubber drain hose 42. The handle assembly 20 includes an integral magnetic ring 32 along an upper edge which helps seal the device 10 against a side or bottom surface of the filter cartridge 100. In use, a user strikes an impact plate 35 located along a bottom surface of the device 10 using a hammer 300, thereby causing the tapping nozzle 24 to penetrate a wall portion of the filter cartridge 100. Once inserted into the cartridge filter 100, the valve portion 36 can be opened to allow the fluid 205 to drain through the drain hose 42 and subsequently into a container 200 where it may be discarded or recycled.

Referring now to FIG. 2, a cross section view of the device 10 is disclosed. The handle assembly 20 is preferably approximately five (5) to seven (7) inches in length and is envisioned to be made using rugged metal materials such as aluminum, painted or plated steel, stainless steel, and the like. The handle assembly 20 further includes a cylindrical body 22 including a cylinder-shaped upper cavity 28 which is recessed into a top surface. The upper cavity 28 provides access to the fluid conveyance portions including the tapping nozzle 24, a lower conduit 27, and a union nut 30 located therewithin for removal or replacement purposes. The upper cavity 28 also provides a reservoir to contain any residual liquid or particulates which may escape when the tapping nozzle 24 or lower conduit 27 is removed or replaced. The tapping nozzle 24 is joined to the subjacent lower conduit 27 by mating surfaces and secured together along a common axis by the threaded union nut 30 in a similar fashion as pipe union or SWAGELOK® fitting. The lower conduit 27 is threadingly attached to an internal drain port 26 of the body 22 which directs and conveys the fluid 205 downward to a lower side surface of the body 22. The tapping nozzle 24 extends upwardly approximately one (1) inch beyond an upper edge of the body 22 and further includes a sharp upper beveled edge 25 being angled at approximately forty-five degrees (45°), thereby providing a pointed tip to pierce and be inserted into the cartridge filter housing 100. Additionally, the union nut 30 allows easy detachment and replacement of the tapping nozzle 24 when worn or damaged from repeated use. The exterior cylindrical shape of the handle assembly 20 provides an ergonomic design allowing a user to comfortably hold the body 22 with one (1) hand. The body 22 also includes a plurality of parallel finger relief grooves 23 which extend around the body 22 in a circular fashion to further enhance a user's grip of the device 10.

The internal drain port 26 includes an intersection of a central vertical through hole at an inlet end and a lower horizontal through hole at an outlet end drilled within the body 22 to form a generally "L"-shaped fluid conveying drain port 26. The drain port 26 further provides for the threaded attachment of the drain valve 36 at the outlet end of the drain port 26 being positioned along a lower side wall of the body 22. The valve 36 preferably includes a miniature ball valve having a quarter-turn handle and a barbed outlet nozzle, thereby providing a press-fit attachment of the drain hose 42.

The body 22 further includes an impact plate 35 permanently affixed to a bottom surface of the body 22 by a perimeter weld 90 or equivalent attachment. The impact plate 35 provides a durable surface on which to strike the handle assembly 20 with a hammer 300 or similar tool, thereby providing a force required to cause the tapping nozzle 24 to penetrate and be inserted into the cartridge filter 100. The impact plate 35 is envisioned to be made of a high-strength carbon steel material capable of withstanding repeated strikes from the hammer 300.

FIG. 3 is a section view of a magnet portion 32 of the device 10 is disclosed. The ring-shaped magnet 32 is permanently affixed to an upper horizontal edge of the handle assembly 20 and provides for the stable connection of the device 10 to the cartridge filter 100. The magnet 32 has an open center region and is affixed to the body 22 by an adhesive layer 34. The adhesive layer 34 is envisioned to include a heavy-duty industrial adhesive compound having sufficient compressive strength capable of withstanding compressive impact forces during attachment of the device 10 to the cartridge filter 100. The magnet 32 further includes a top sealing layer 33 envisioned to be made of a medium-density rubber approximately one-eighth (%) inch thick adhesively bonded to the magnet 32. The sealing layer 33 provides a compliant sealing surface which when compressed between the magnet 32 and the cartridge filter 100, is envisioned to minimize leakage of the fluid 205 being drained.

It is envisioned that other styles and configurations can be easily incorporated into the teachings of the present disclosure and only one particular configuration has been shown and described for purposes of clarity and disclosure and not by way of limitation of scope.

The preferred embodiment can be utilized by the common user in a simple and effortless manner with little or no training. After initial purchase or acquisition of the device 10, it would be installed and utilized as indicated in FIG. 1.

The method of installing and utilizing the device 10 to drain excess fluid 205 may be achieved by performing the following steps: procuring the device 10; selecting a cartridge filter 100 or similar replaceable fluid vessel to be drained; closing the valve 36, if open; positioning the bevel portion 25 of the tapping nozzle 24 against a bottom or side surface of a cartridge filter 100; striking the impact plate portion 35 of the body 22 to cause penetration and insertion of the tapping nozzle 24 into the cartridge filter 100; allowing the magnet 32 to contact and be attracted to a metallic wall portion of the cartridge filter 100; allowing the sealing layer 33 to seal the device 10 against the cartridge filter 100; positioning the drain hose 42 into, or above a fluid container 200 into which the fluid 205 is to be drained; rotating the valve handle portion 37 of the valve 36 to allow the excess fluid 205 to be evacuated from the cartridge filter 100; waiting a period of time for the fluid 205 to drain from the cartridge filter 100 into the container 200; removing the device 10 from the cartridge filter 100 by pulling downwardly; removing the cartridge filter 100 from the vehicle 105 in a conventional manner; visually analyzing the fluid 205 or disposing of the fluid 205 in a responsible manner; cleaning all external surfaces of the body 22 and the upper cavity 28 to prepare the device 10 for storage; and, benefiting from reduced spillage of fluids 205 and possible resultant contamination during cartridge filter 100 removal, afforded a user of the present invention 10.

The method of installing a new tapping nozzle 24 to the device 10 may be achieved by performing the following steps: loosening and removing the union nut 30 from the lower conduit 27; removing the worn or damaged tapping nozzle 24; placing a new tapping nozzle 24 upon the lower conduit 27; inserting the union nut over the tapping nozzle 24; threadingly engaging the union nut 30 with the lower conduit 27; tightening the union nut 30; and, utilizing the device 10 to drain fluids 205 as previously described above.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A tap and draining device for a filter cartridge comprising:

a generally cylindrical handle assembly removably coupled to an exterior of said filter cartridge and comprising a magnetic ring disposed along an upper horizontal edge for providing a magnetic attraction to said filter cartridge exterior;

a sealing layer applied to a top surface of said magnetic ring for providing a fluid restricting seal between said handle assembly and said filter cartridge;

a lower conduit removably connected to said handle assembly;

a tapping nozzle protruding from an upper end of said handle assembly for penetrating said filter cartridge exterior and coming into fluid communication with a fluid filled interior of said filter cartridge, said tapping nozzle having an outwardly flanged lower end and an opposing beveled upper end terminating in a point for puncturing said filter cartridge exterior and removably connected and compressively mated to and in fluid communication with an upper end of said lower conduit by a union nut;

a drain port disposed within said handle assembly, said drain port having an inlet end in fluid communication with a lower end of said lower conduit and an outlet end exiting said exterior of said handle assembly;

a valve removably connected to and in fluid communication with said drain port outlet end for providing control of a fluid flow from said drain port;

a flexible drain hose removably connected to and in fluid communication with said valve opposite said drain port outlet end; and, an impact plate affixed to a bottom surface of said handle assembly;

wherein striking said impact plate imparts a force to drive said tapping nozzle into said filter cartridge interior.

2. The device of claim 1, wherein said handle assembly further comprises an upper cavity disposed within said upper end thereof for accessing said tapping nozzle and said lower conduit.

3. The device of claim 2, wherein said magnetic ring is affixed to said handle assembly upper horizontal edge by an adhesive layer between a top surface of said handle assembly upper horizontal edge and a bottom surface of said magnetic ring.

4. The device of claim 1, wherein said handle assembly further comprises a plurality of finger relief grooves extending around a perimeter of an exterior surface for providing an ergonomic grip.

5. The device of claim 4, wherein said handle assembly is approximately between five and seven inches long.

6. The device of claim 1, wherein said sealing layer is formed of a thin layer of medium density rubber material.

7. The device of claim 1, wherein said union nut further comprises a central aperture disposed in a top surface for receiving said tapping nozzle and an internally threaded lower end removably connected to said lower conduit upper end;

wherein said tapping nozzle flanged lower end is secured between said union nut top surface and said lower conduit upper end.

8. A tap and draining device for a filter cartridge comprising:

a handle assembly removably coupled to an exterior of said filter cartridge, said handle assembly further comprising an upper cavity disposed within an upper end thereof and a generally L shaped drain port disposed therethrough, said drain port having an inlet end with interior threading centrally disposed within said upper cavity and an outlet end with interior threading exiting a side wall of said handle assembly;

a lower conduit disposed within said upper cavity having an upper end with exterior threading and a lower end with exterior threading adapted to threadingly mate with said drain port inlet end;

a tapping nozzle having an outwardly flanged lower end and a beveled upper end terminating in a point for penetrating said filter cartridge exterior and coming into fluid communication with a fluid filled interior of said filter cartridge, said tapping nozzle is securely mated to and in fluid communication with said lower conduit upper end;

a union nut having a central aperture disposed in a top surface for receiving said tapping nozzle and a lower end with internal threading adapted to threadingly mate with said lower conduit upper end and compressively mate said tapping nozzle to said lower conduit upper end;

a valve threadingly connected to and in fluid communication with said drain port outlet end for providing control of a fluid flow from said drain port;

a flexible drain hose removably connected to and in fluid communication with said valve opposite said drain port outlet end;

an impact plate affixed to a bottom surface of said handle assembly; and, a magnetic ring affixed to an upper horizontal edge of said handle assembly between said handle assembly side wall and said upper cavity;

wherein striking said impact plate imparts a force to drive said tapping nozzle into said filter cartridge interior.

9. The device of claim 8, wherein said handle assembly further comprises a plurality of finger relief grooves extending around a perimeter of an exterior surface for providing an ergonomic grip.

10. The device of claim 9, wherein said magnetic ring is affixed to said handle assembly upper horizontal end by an adhesive layer between a top surface of said handle assembly upper horizontal edge and a bottom surface of said magnetic ring.

11. The device of claim 10, further comprising a sealing layer applied to a top surface of said magnetic ring for providing a fluid restricting seal between said handle assembly and said filter cartridge.

12. The device of claim 11, wherein said sealing layer is formed of a thin layer of medium density rubber material.

13. The device of claim 8, further comprising a sealing layer applied to a top surface of said magnetic ring for providing a fluid restricting seal between said handle assembly and said filter cartridge.

14. The device of claim 13, wherein said magnetic ring is affixed to said handle assembly upper horizontal end by an adhesive layer between a top surface of said handle assembly upper horizontal edge and a bottom surface of said magnetic ring.

15. The device of claim 14, wherein said handle assembly further comprises a plurality of finger relief grooves extending around a perimeter of an exterior surface for providing an ergonomic grip.

16. A method of draining fluid from a fluid filled interior of a filter cartridge, said method comprising the steps of:

providing said filter cartridge having at least an exterior body for housing said fluid filled interior;

providing a tap and draining device for a filter cartridge comprising a handle assembly removably coupled to an exterior of said filter cartridge, said handle assembly further comprising an upper cavity disposed within an upper end thereof and a generally L shaped drain port disposed therethrough, said drain port having an inlet end with interior threading centrally disposed within said upper cavity and an outlet end with interior threading exiting a side wall of said handle assembly; a lower conduit disposed within said upper cavity having an upper end with exterior threading and a lower end with exterior threading adapted to threadingly mate with said drain port inlet end; a tapping nozzle having an outwardly flanged lower end and a beveled upper end terminating in a point for penetrating said filter cartridge exterior and coming into fluid communication with an interior of said filter cartridge, said tapping nozzle is securely mated to and in fluid communication with said lower conduit upper end; a union nut having a central aperture disposed in a top surface for receiving said tapping nozzle and a lower end with internal threading adapted to threadingly mate with said lower conduit upper end and compressively mate said tapping nozzle to said lower conduit upper end; a valve threadingly connected to and in fluid communication with said drain port outlet end for providing control of a fluid flow from said drain port; a flexible drain hose removably connected to and in fluid communication with said valve opposite said drain port outlet end; an impact plate affixed to a bottom surface of said handle assembly; and, a magnetic ring affixed to an upper horizontal edge of said handle assembly between said handle assembly side wall and said upper cavity;

positioning said valve in a closed position, if in an open position;

placing said beveled upper end of said tapping nozzle in contact with a bottom or side surface of said cartridge filter exterior body;

striking said impact plate, imparting a force to drive said tapping nozzle to penetrate said cartridge filter;

inserting said tapping nozzle into said fluid filled interior;

placing said magnetic ring in contact with said cartridge filter exterior body; routing said drain hose to a fluid receiving container into which said fluid is to be drained; and, positioning said valve in said open position to allow said fluid to be evacuated from said fluid filled interior.

* * * * *